US010856089B2

(12) United States Patent
Best et al.

(10) Patent No.: US 10,856,089 B2
(45) Date of Patent: Dec. 1, 2020

(54) METHOD FOR OPERATING A HEARING AID, AND HEARING AID

(71) Applicant: SIVANTOS PTE. LTD., Singapore (SG)

(72) Inventors: Sebastian Best, Erlangen (DE); Thomas Pilgrim, Erlangen (DE); Christoph Lueken, Baiersdorf (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/409,357

(22) Filed: May 10, 2019

(65) Prior Publication Data

US 2019/0349692 A1 Nov. 14, 2019

(30) Foreign Application Priority Data

May 11, 2018 (DE) ..... 102018207346 U

(51) Int. Cl.
*H04R 25/00* (2006.01)

(52) U.S. Cl.
CPC ..... *H04R 25/505* (2013.01); *H04R 25/356* (2013.01); *H04R 25/40* (2013.01); *H04R 25/407* (2013.01); *H04R 2225/41* (2013.01); *H04R 2225/43* (2013.01); *H04R 2225/55* (2013.01)

(58) Field of Classification Search
CPC .... H04R 25/356; H04R 25/40; H04R 25/407; H04R 25/505; H04R 25/552; H04R 2225/41; H04R 2225/43; H04R 2225/55
USPC ..... 381/23.1, 313, 320, 321, 91, 92, 106
See application file for complete search history.

(56) References Cited

U.S. PATENT DOCUMENTS

| | | | | |
|---|---|---|---|---|
| 4,712,866 | A | 12/1987 | Dyott | |
| 6,751,325 | B1 | 6/2004 | Fischer | |
| 7,305,100 | B2 * | 12/2007 | Pedersen | H04R 25/356 381/106 |
| 9,241,222 | B2 | 1/2016 | Ma | |
| 2004/0190734 | A1 * | 9/2004 | Kates | H04R 25/356 381/106 |
| 2005/0175204 | A1 | 8/2005 | Bock | |

(Continued)

FOREIGN PATENT DOCUMENTS

| | | | |
|---|---|---|---|
| DE | 102010041740 | A1 | 4/2012 |
| EP | 0254462 | A1 | 1/1988 |

(Continued)

*Primary Examiner* — Huyen D Le
(74) *Attorney, Agent, or Firm* — Laurence A. Greenberg; Werner H. Stemer; Ralph E. Locher

(57) ABSTRACT

A method operates a hearing aid where the hearing aid generates an input signal from acoustic signals from the environment. The hearing aid has a signal processor which is configured to modify the input signal and thereby generate an output signal. The signal processor has an automatic gain control for modifying the input signal, and has a compressor that can be operated with a compression scheme. The environment is divided into a plurality of directions of which one is selected by a direction determination unit as a relevant direction. The input signal is modified in a direction-dependent manner by the compressor being operated with a compression scheme, which is set dependent on the relevant direction, so that acoustic signals from the relevant direction are emphasized compared to acoustic signals from other directions.

12 Claims, 4 Drawing Sheets

(56) References Cited

U.S. PATENT DOCUMENTS

| | | | | |
|---|---|---|---|---|
| 2012/0082330 | A1 | 4/2012 | Kornagel et al. | |
| 2013/0010973 | A1* | 1/2013 | Ma | H04R 25/356<br>381/23.1 |

FOREIGN PATENT DOCUMENTS

| | | |
|---|---|---|
| EP | 2544463 | 1/2013 |
| WO | 0019770 A1 | 4/2000 |

* cited by examiner

METHOD FOR OPERATING A HEARING AID, AND HEARING AID

CROSS-REFERENCE TO RELATED APPLICATION

This application claims the priority, under 35 U.S.C. § 119, of German application DE 10 2018 207 346.5, filed May 11, 2018; the prior application is herewith incorporated by reference in its entirety.

BACKGROUND OF THE INVENTION

Field of the Invention

The invention relates to a method for operating a hearing aid and to a corresponding hearing aid.

In its most general form a hearing aid contains a microphone, a signal processor and a receiver, wherein the receiver is also referred to as a loudspeaker. A hearing aid is used, for example, for treating a hearing-impaired user and to compensate for a hearing loss. The microphone generates an input signal from acoustic signals in the environment, which is fed to the signal processor. The signal processor modifies the input signal and generates an output signal from it, which is thus a modified version of the input signal. To compensate for a hearing loss, for example, the input signal is amplified with a certain gain factor. The output signal is finally output by the speaker, by the latter converting the output signal into an acoustic signal. The input signal and the output signal are electrical signals, which are therefore also abbreviated to signals. By contrast, the acoustic signals from the environment and the acoustic signal output from the speaker are acoustic signals.

A hearing aid is typically either a monaural worn on only one side of the head or binaural, in which case it then has two separate devices, which are worn on different sides of the head. Depending on the type, the hearing aid is worn on, in or behind the ear or a combination thereof. Common types of hearing aids are, for example, BTE, RIC and ITE hearing aids. These differ in particular in their design and mode of wearing.

In principle, it is possible to use a so-called beam former in a hearing aid to implement directional hearing, i.e. in order to prefer acoustic signals from a certain direction over other acoustic signals and to amplify them more strongly, i.e. to emphasize them. A directional microphone is used for this purpose, which is usually a microphone array consisting of at least two microphones. The directional microphone is housed in the hearing aid and receives the acoustic signals from the environment in two different positions. Accordingly, multiple input signals are generated, which are then appropriately combined by the signal processor in order to achieve a directivity, i.e. to align the beam former in a certain direction and then emphasize acoustic signals from this direction. For example, in this way, a person speaking in front of the user is amplified compared to the rest of the environment, which improves the intelligibility of the speech.

The use of a beam former is problematic in environments which are more challenging than those which have only one relevant sound source. In environments where relevant acoustic signals and, in particular, information for the user can potentially arrive from multiple directions, such relevant acoustic signals may sometimes be suppressed, because the beam former is already directed towards a different sound source. In the above example with the speaker in the frontal region, the region to the rear of the user will be strongly suppressed in relation to the frontal region, so that sound sources in the area to the rear of the user can only be perceived poorly or not at all.

SUMMARY OF THE INVENTION

Against this background, an object of the invention is to improve the enhancement of acoustic signals from a certain direction in a hearing aid and thereby, in particular, improve the speech intelligibility and to suppress other potentially relevant acoustic signals as little as possible, in order that potentially relevant acoustic signals from other directions can continue to be perceived. To this end, a method for operating a hearing aid and a corresponding hearing aid will be specified.

The object is achieved according to the invention by a method having the features of the independent method claim and by a hearing aid having the features of the independent hearing aid claim. Advantageous configurations, extensions and variants form the subject matter of the dependent claims. In these the comments in relation to the method also apply, mutatis mutandis, to the hearing aid, and vice versa.

The method is used for operating a hearing aid. In operation, the hearing aid is worn, in particular by a user. The hearing aid first generates an input signal from acoustic signals from the environment. To this end, the hearing aid has at least one microphone which receives the acoustic signals and converts them into the ambient signal. The hearing aid also has a signal processor, which is configured to modify the input signal and thereby generate an output signal. The hearing aid also has a speaker to output the output signal, i.e. to convert the output signal into an acoustic signal, which is output to the user. In particular, only one output signal is generated for each speaker of the hearing aid. In the case of a monaural hearing aid, therefore, only one output signal is generated. In a binaural hearing aid two output signals are generated, namely one for each side of the user's head. The input signal is modified, in particular with regard to a particular hearing profile of the user. In a preferred configuration the hearing aid is a hearing aid for treating a hearing-impaired user, and the hearing profile differs from a person with normal hearing due to a hearing deficit. In this respect, the input signal is thus modified in such a way that the hearing deficit, at least in some cases, is preferably fully compensated. Typically, the input signal is amplified for this purpose. In particular, a respective output signal is thus matched to the hearing profile of the user on the respective ear.

In order to modify the input signal, the signal processor has an automatic gain control (abbreviated to: AGC), which has a compressor which can be operated with a compression scheme. The user's environment is then subdivided into a plurality of directions, one of which is selected as a relevant direction by a direction determination unit. The relevant direction is configured to be emphasized over other directions, so that acoustic signals from the relevant direction are emphasized by these acoustic signals from the relevant direction undergoing a greater amplification relative to other acoustic signals. For this purpose, the input signal is modified in a direction-dependent manner by the compressor being operated with a compression scheme which is set dependent on the relevant direction, so that acoustic signals from the relevant direction are emphasized compared to acoustic signals from other directions. In other words, the information as to the direction in which a relevant sound source is located is used to selectively modify the input signal and to reproduce this sound source more clearly for the user. In doing so, a specific sound source in a particular direction is not initially selected and selectively amplified, but instead a directivity is obtained automatically due to the fact that the compression scheme is matched to the sound source in the relevant direction, and therefore exactly this sound source and hence the associated direction are selectively emphasized. In a binaural hearing aid this is preferably carried out in equal measure on both sides.

The relevant direction is selected according to its relevance to the user. In particular, a direction is relevant if a sound source of a particular type is present there, for example, a person speaking, or if the sound source has a higher volume than other sound sources in the same direction, i.e. a higher sound level, for example, a person speaking in a crowd. Determining and, in particular, also selecting the relevant direction is performed by the direction determination unit. In a suitable design, the input signal is analyzed by the direction determination unit and this analysis is used as a basis for determining the direction in which a sound source is located which is relevant to the user, so that this direction is then selected as the relevant direction. In an advantageous design, the hearing aid and specifically the direction determination unit has a classifier for this purpose, to assign sound sources in the environment to a specific type, so that the direction selected as the relevant direction is that in which a sound source of a particular type is located.

In principle, it is possible to implement the effect described above, not identically but to a first approximation, with a beam former which by the appropriate combination of multiple input signals amplifies a particular direction in relation to other directions and suppresses the other directions accordingly. This approach would result in the previously mentioned disadvantages. A more suitable design at least temporarily mitigates these disadvantages, by switching on the beam former only in certain situations and to do so, activating it depending on the noise level of the environment, i.e. depending on the strength of the interfering noise level in the environment in comparison to useful signals. This is indicated by the signal-to-noise ratio (SNR for short). At high SNR the beam former is disabled, so that acoustic signals from unexpected directions, in particular from the rear, i.e. from behind, are not inadvertently suppressed. This is based on the consideration that at high SNR no beam forming is needed to enhance the speech intelligibility, and therefore its use is conveniently waived. In the case of a comparatively low SNR the beam former is then enabled and directed at a sound source which is relevant to the user, for example, a speaker in the frontal region of the user, i.e. in front of the user. The beam former is then used to achieve a high speech intelligibility despite a low SNR. This significant point here is that the beam former is only enabled in specific situations, namely, when needed. In the cases in which the beam former is activated, this continues to happen as described to the detriment of acoustic signals from other directions, which are then suppressed along with the noise, and possibly unintentionally.

In the present case the aim is to avoid the strong suppression of acoustic signals from directions other than the relevant direction—as described above—which is inherent in the use of a beam former. Therefore, to improve the emphasis of a specific direction, or more precisely of one or more acoustic signals coming from this direction, instead of the directivity of a beam former, an automatic gain control AGC is used. An AGC is characterized, in particular, by the fact that it performs a level-dependent modification of the input signal, in order to generate the output signal in such a way that it is optimally matched to the hearing profile and, in particular, a hearing deficit of the user. The AGC is, in particular, a part of the signal processor of the hearing aid. To provide the level-dependent modification an AGC generally has a compressor which controls the gain of the input signal as a function of its level, i.e. the input level, and in conjunction with a specific compression scheme. The compression scheme specifies the gain factor to be used for the input signal at a given input level. The compression scheme is parameterized by one or more compression parameters, preferably one or more knee points, one or more compression ratios for one or more specific level ranges of the input level, a switch-on time (also referred to as the attack), a switch-off time (also referred to as the release), or a combination of these. A knee point specifies a transition between two levels ranges with different compression ratios.

The compressor of the AGC is now operated in a direction-dependent manner with a suitable compression scheme, so that the acoustic signals from different directions are compressed by different amounts. In this respect, the proposed approach represents an alternative to a beam former, but, in principle, can also be profitably used in combination with a beam former. In the present case the user's environment is divided into a plurality of directions and the compressor is set such that acoustic signals from the relevant direction, i.e. relevant acoustic signals, are emphasized for the user. Depending on what type of sound source is located in which direction, a suitable compression scheme is selected and set accordingly. This means a classical strong directivity is initially foregone in favor of performing an advantageously gradual adjustment to the modification of the input signal.

By selecting an appropriate compression scheme one of the directions is then selectively emphasized, preferably in order to selectively increase the intelligibility of speech in this direction, without at the same time causing a suppression in the other directions. As a result, by means of the compressor and more generally by means of the AGC, a directivity is created in such a way that, by using a specific compression scheme in a given direction, a relevant sound source is emphasized in precisely that direction. In particular, the emphasis is realized by selecting a suitable compression scheme which is matched to the sound source to be emphasized, so that other sound sources recede into the background relative thereto, but are not completely suppressed. As a result, a reduced directivity compared to a beam former is advantageously achieved and overall, a compromise is found between the strongest possible emphasis in one direction and the weakest possible suppression in the other directions. In the case of an emphasis of the frontal region, for example, the user can then continue to perceive acoustic signals from the rear area.

A key concept in the present case is the direction-dependent compression for emphasizing sound sources from a certain direction. In other words, a direction-dependent parameterization of the compressor is carried out. This advantageously results in a gradual directional effect being achieved by the compressor and generally by the AGC. Using the AGC, one or more sound sources in a specific direction are therefore emphasized. In addition, it is possible to achieve a corresponding directional effect in multiple directions at the same time, so that the usual limitation of a beam former to only one emphasized direction is advantageously overcome.

In a particularly preferred design, the direction determination unit has a beam former which is used to determine the relevant direction. This is based on the idea that a beam former is specifically designed to generate directed signals and is therefore particularly suitable for dividing the environment into a plurality of directions. For this purpose, the input signal is fed to the beam former and then for each of the directions, processed in such a way that for each of the directions a directed input signal is generated, which results only or at least predominantly from acoustic signals from a single direction. Each directed input signal is thus assigned to one of the directions. The directed input signals are then examined for the presence of a sound source relevant to the user, for example, by means of an additional classifier or simply on the basis of a signal characteristic of the directed input signal, e.g. its level or SNR. The direction of the directed input signal that contains a relevant sound source is then selected as the relevant direction. The compression scheme is then set such that the exact same sound source is emphasized, the overall result being that the relevant direction is also emphasized. The beam former is thus firstly advantageously used to perform the division of the environment into different directions and to determine the relevant direction. On the other hand, the beam former is precisely not used for generating an output signal, which would also be directed by a combination of the directed input signals. This function is instead obtained from the specific control of the compressor.

The beam former generates the directed input signals, in particular from a plurality of input signals which are generated accordingly by a plurality of microphones, each of which converts the acoustic signals from the environment into a respective input signal. The microphones are arranged at different positions of the hearing aid and thus form a microphone array. In this respect the various input signals can also be considered to be combined as a single input signal, which is generated by the microphone array. To generate the individual directed input signals the input signals of the various microphones are suitably combined with each other by the beam former. In a preferred configuration, the microphone array has two microphones and the beam former generates four directed input signals for the four directions front, rear, left and right. Other configurations are conceivable and also suitable, however.

The directed input signals which are generated by the beam former do not in principle need to be used further to generate the output signal. In a suitable design the directed input signals are instead used only to identify the relevant direction, and the AGC, and specifically the compressor, act upon the input signal as a whole. In an advantageous variant, by contrast, the directed input signals are fed to the AGC, in particular, instead of the input signal per se, and processed separately from each other by means of the AGC, in order to implement a direction-dependent compression. In this case, the AGC and specifically the compressor act upon individual parts of the input signal, namely the directed input signals, which of course represent the input signal divided according to direction, separately and independently of each other. The separately processed directed input signals are then finally mixed together to form an output signal. Preferred embodiments of both configurations are presented in more detail in the following. The various embodiments, or parts thereof, may in principle also be combined with each other. The comments made in relation to a specific design also apply mutatis mutandis to the other embodiments.

In a particularly simple and advantageous configuration the compression scheme is defined by at least one compression parameter, in particular as described above, and the compression scheme is set according to the relevant direction set by varying the compression parameter as a function of the relevant direction. In a first alternative design it is only possible to switch between at least two discrete values. In a second alternative design the compression parameter, by contrast, is continuously varied, i.e. is continuously adjusted. In this embodiment a suitable parameterization for the compressor as direction-dependent is selected and adjusted, and the compression of the input signal is controlled accordingly.

In a further advantageous design, the compressor has a plurality of instances which are operated with different instance schemes. These instance schemes are strictly speaking compression schemes, as described above. A particular instance scheme is then designed to emphasize a particular type of acoustic signal, for example, to emphasize speech or other sound, such as music. In this context, the instances are also designated as compression instances. The input signal is fed to each of the instances, which then generate a corresponding number of modified input signals, which are then combined together to form the output signal. Essentially the same input signal is used for all instances, so that overall the compressor acts upon the entire input signal. The significant point here is that a relative proportion of the modified input signals to one another in the output signal is adjusted depending on the relevant direction, so that the compression scheme is set as a mixture of the instance schemes. Thus different versions of the input signal are mixed in a direction-dependent way, i.e. depending on the relevant direction one instance or the other has more or less influence on the output signal. The mixing, also merging or combination, is advantageously implemented by a mixer, which then generates the output signal.

A particular advantage of this design is that the individual instances can each be, and preferably also are, operated with a fixed instance scheme, and yet an overall variable compression scheme is obtained. The input signal is processed differently by the individual instances in parallel, so that the compression scheme of the compressor as a whole is set by the fact that the ratio of the proportions of the modified input signal are suitably selected and adjusted. In a first variant a selection is made from two discrete proportions, and in a second variant, by contrast, the ratio is changed continuously. To set or change the proportions, for example, the level of the input signal before the respective instance is varied accordingly, or alternatively or in addition the level of the respective modified input signal is varied according to the respective instance.

An advantage of the aforementioned design is, in particular, the fact that the instances can be operated and preferably are also operated with a predefined, i.e. a fixed, instance scheme, so that in operation the particular instance scheme itself is not changed. The instances are thus dedicated instances for different types of acoustic signals. In another suitable variant however, the individual instances are also adjustable, i.e. they have modifiable parameters which are then changed during operation so that the instances are then not static, as described previously, but dynamic.

In a further advantageous embodiment the input signal has a plurality of directed, i.e. direction-dependent input signals, each of which is assigned to one of the plurality of directions. The compressor then has one instance for each of the directed input signals, which is operated with a respective instance scheme. In this context, the instances are also referred to as direction instances and the instance schemes as direction schemes. The instance schemes are strictly speaking compression schemes, as described above. One of the directed input signals is fed to a particular instance, so that the compression scheme is set as a mixture of the instance schemes. In principle, the comments in relation to the previous design with a plurality of compression instances also apply to the design with a plurality of direction instances, with the difference that it is not the entire input signal which is fed to a single direction instance, but a conditioned input signal, which is then modified. In this way, i.e. by means of a respective direction instance a modification of only one specific direction component of the input signal is thus carried out, so that the individual directions are processed independently of each other in an optimal way using the AGC.

A specific advantage of the above-mentioned design with a plurality of instances, specifically direction instances, is in particular, that in each direction the specific situation applying there can be responded to, and preferably also is responded to, separately. To this end, in an advantageous extension, for each of the directions a respective instance scheme for the given directed input signal is set depending on a type of an acoustic signal in the assigned, i.e. the associated direction. In other words: for a given direction it is determined whether a sound source is present there, which is emitting acoustic signals of a specific type, e.g. speech or music. In addition, the type is also determined, for example by means of a classifier. Depending on the type of the acoustic signal a corresponding instance scheme is then set for the instance.

By the subdivision into different directions in combination with the option to also use different compression schemes for them, i.e. more accurate instance schemes, the directions can also advantageously be processed independently of each other and are conveniently modified as needed. The generation of the directed input signals is preferably carried out by a beam former. A beam former is characterized in particular by the fact that it emphasizes acoustic signals from a certain direction, so that a beam former is therefore suitable for generating directed input signals. For this purpose, the beam former is in particular applied to each of the plurality of directions, in order then to generate an associated directed input signal for each of these directions. In the case of a conventional beam former only one direction-dependent input signal would be used and then output as an output signal after modification. In contrast, in the present case the plurality of directed input signals from the different directions using is modified by means of the AGC, so that as a result input signals compressed in a direction-dependent manner can be generated. These are then merged to form an output signal and finally output.

The embodiments with a plurality of directional instances and the embodiment with a plurality of compression instances are combined with each other in an advantageous embodiment. For example, in such a way that a respective direction instance is assembled from a plurality of compression instances, so that a single directed input signal is then modified, for example, with different fixed instance schemes and the different modified directed input signals are subsequently mixed together to form the output signal.

As an equivalent to the chosen wording with a plurality of instances of the compressor it is also possible to refer to this as an AGC with multiple AGC instances, which then each have one or more appropriately designed compressors. These different formulations are considered to be equivalent and differ at most in particular in the specific circuit implementation, but not in terms of the functionality obtained, which is the point at issue here.

Preferably, the compression scheme, in particular the instance scheme which is set, is selected from a set of compression schemes comprising: a speech scheme for emphasizing speech components, a sound scheme for adapting only to a hearing profile of a user of the hearing aid. This means the system advantageously switches as required between a speech scheme, which is designed for optimum speech intelligibility, and a sound scheme, which is designed to provide the most faithful possible reproduction of the acoustic signals from the environment. When the speech scheme is used the compression thus emphasizes speech, whereas in the sound scheme the environment itself is emphasized, in particular without specific consideration of individual sound sources or individual types of acoustic signals. This enables a particularly realistic sound reproduction, which is especially advantageous when the acoustic signal is music.

The option to select the speech scheme is used to handle the particularly important case of the presence of speech in the environment. In order to make such speech, i.e. an acoustic signal from a human speaker, maximally comprehensible for the user, a compression scheme is set which improves the intelligibility of speech. In this case a faithful reproduction of other acoustic signals or noises is of minor importance, and speech is made primarily recognizable for the user instead. Conversely, in an environment without speech the main objective is a maximally realistic reproduction of the acoustic environment, and so the best possible sound quality should therefore be aimed for. This is implemented by the facility for selecting the sound scheme. The best possible sound quality is understood, in particular, to mean that a hearing loss of the user is compensated in the most optimal way, thus a maximum hearing loss compensation is performed. This is particularly important in the case of music, which is sometimes severely distorted by a compression scheme designed for improved speech intelligibility. The same applies to other acoustic signals in the environment which are sometimes so severely distorted that they are no longer recognizable to the user and can no longer be classified.

A particular advantage of the direction-dependent compression is in particular the solution to the problem that a single compression scheme, which is configured for a particular situation, for example speech or sound, is not optimal in an environment in which both speech as well as other acoustic signals, in particular music, are present. In a particularly advantageous embodiment, as part of the direction-dependent compression the environment is divided into a plurality of directions and the acoustic signals of each particular direction are modified with an optimal compression scheme, i.e. one which is matched to the respective acoustic signals. Thus, instead of analyzing the entire environment as a whole and performing the same compression for the environment as a whole, a corresponding analysis is carried out separately for each individual one of the plurality of directions.

Advantageously, the input signal is only modified in a direction-dependent way when a directed acoustic signal is detected in the environment, and otherwise the input signal is modified independently of the direction, i.e. all directions are modified in the same way. In other words, the hearing aid has a basic operating mode, in which none of the directions is specifically emphasized by setting the compressor. In principle, the possibility also exists that none of the directions is a relevant direction and accordingly, no relevant direction can be selected, so that the determination fails. In general, in the case where no relevant sound source or no relevant acoustic signal is or can be detected in a particular direction, i.e. if there is no relevant acoustic signal present, then a basic scheme is used as a compression scheme for this direction. In the basic operating mode the basic scheme is then used for each direction. The basic scheme is advantageously the sound scheme described above, which ensures a particularly faithful reproduction of all acoustic signals in the environment overall. If there is no specific acoustic signal present in one direction, then the resulting acoustic signal type obtained is in particular the type "background".

In a suitable embodiment a plurality of directions are each selected as relevant directions. This is enabled in particular by the specific direction-dependent compression. By contrast, with a beam former alone only a single direction can typically be emphasized. In the present case, however, it is possible to select a plurality of directions at the same time as relevant directions. In this way, for example, multiple speakers in the environment are advantageously emphasized for the user. Alternatively or in addition, suddenly occurring warning or alarm signals are emphasized, without suppressing other relevant acoustic signals.

The different directions are preferably regions, which are obtained by a subdivision of the environment into sectors from the point of view of the user. The user of the hearing aid forms a central point in the environment, from which the environment is divided into a number of sectors, i.e. angular segments. Each region thus corresponds to a sector and the sectors are lined up around the user. In a particularly expedient embodiment, the environment is divided into exactly four directions, namely front, rear, left and right. These direction indicators refer to the direction of view of the user, so that "front" identifies a frontal area, "rear" identifies a rear region and "left" and "right" a region to the left and right side respectively. Each of the four directions contains, in particular, an angular segment of 90°. The environment is thus divided into four quadrants. In principle a subdivision into only two regions is also suitable, such as front and rear, i.e. a frontal region and a rear region. In an alternative design a subdivision into regions is carried out not only in a plane, but in a three-dimensional space. In this case, in an advantageous embodiment an additional region is formed facing upwards. An additional region facing downwards is thus also advantageous.

A hearing aid according to the invention is designed for carrying out the method described above. In particular, the hearing aid has a signal processor, which is designed for carrying out the method. The hearing aid is configured to be either monaural or binaural, thus it has either one or two separate devices, each of which is worn in or on the ear. The hearing aid is used, in particular, for treating a hearing-impaired user. The hearing aid has at least one microphone and at least one loudspeaker, wherein more specifically each individual device of the hearing aid has at least one, preferably a plurality, of microphones, as well as a loudspeaker. Each individual device has a separate housing, in which the associated microphones are housed. Depending on the type of hearing aid, the speaker is also accommodated in the housing, or at least connected to the housing via a supply cable. Each individual device also has an earpiece, which in particular can be inserted in the ear of the user in order to output the acoustic signals, which the speaker generates from the output signal, to the user. Advantageously, the hearing aid has a battery for its energy supply, wherein advantageously each individual device has its own battery, which is accommodated in particular in the housing.

In the following, exemplary embodiments of the invention are explained in more detail based on a drawing. The above general remarks apply mutatis mutandis to the specific exemplary embodiments shown below.

Other features which are considered as characteristic for the invention are set forth in the appended claims.

Although the invention is illustrated and described herein as embodied in a method for operating a hearing aid, and a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
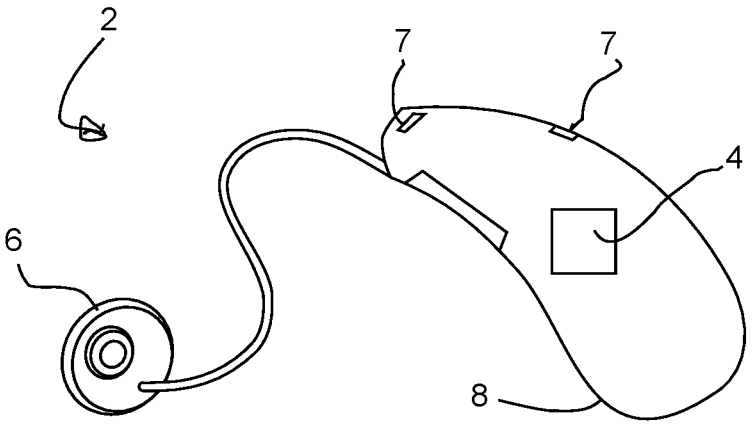
FIG. 1 is an illustration of a hearing aid.

Referring now to the figures of the drawings in detail and first, particularly to FIG. 1 thereof, there is shown an exemplary embodiment of a hearing aid 2. The hearing aid 2 has a signal processor 4. The hearing aid 2 is configured to be either monaural or binaural, thus it has either one or two separate devices, each of which is worn in or on the ear. FIG. 1 shows only one individual device. The hearing aid 2 is used in the present case to treat a hearing-impaired user N. The hearing aid 2 has at least one microphone 7 and at least one speaker 6. The example individual device shown in FIG. 1 has two microphones 7 and one speaker 6, which here is arranged externally with respect to a housing 8 so that the hearing aid 2 shown is a so-called RIC device.

Figure 2:
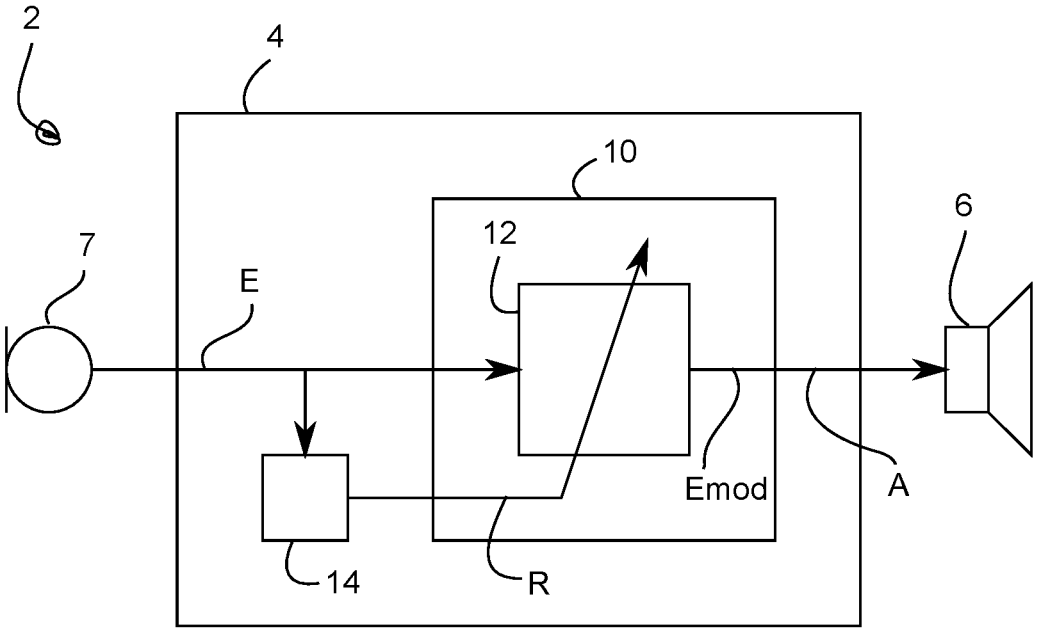
FIG. 2 is a block wiring diagram of the hearing aid.
Figure 3:
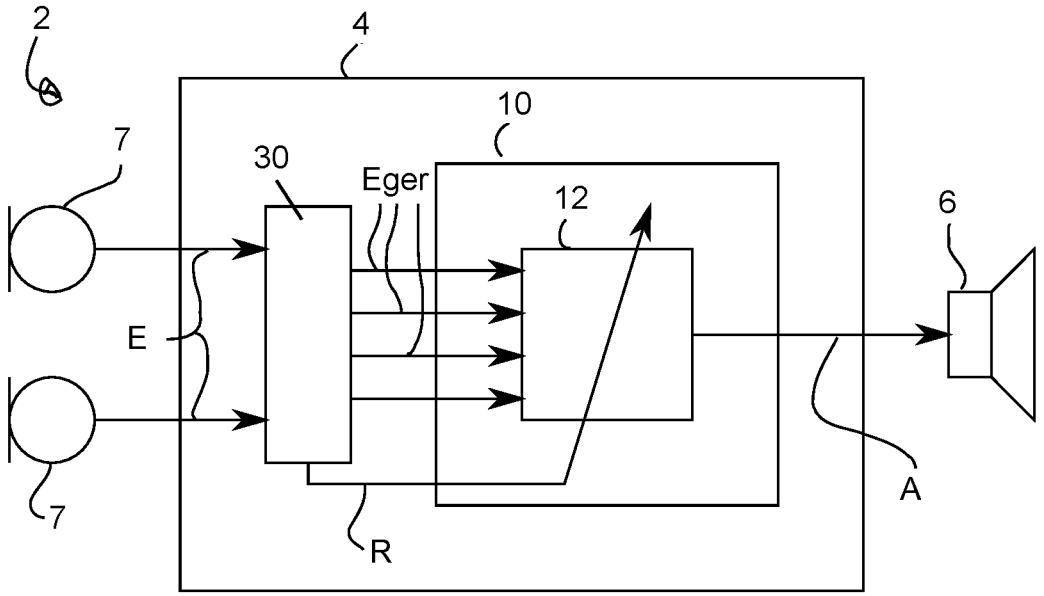
FIG. 3 is a block wiring diagram of a further hearing aid.

The signal processor 4 is configured to provide direction-dependent compression. Two exemplary embodiments are shown in FIGS. 2 and 3. Each of these shows a block wiring diagram of the hearing aid 2. The signal processor 4 generally includes an automatic gain control 10, AGC for short, which in turn has a compressor 12. The signal processor 4 also has a direction determination unit 14, by means of which the compressor 12 is controlled. To this end, the direction determination unit 14 determines a relevant direction R, depending on which the compressor 12 is controlled.

The signal processor 4 is generally supplied with an input signal E, which is generated by a microphone 7. The input signal E is then fed to the AGC 10, which modifies the input signal E and forwards it as an output signal A for output to the speaker 6. In the present case, the input signal E is also used to determine the relevant direction R, i.e. for direction determination and is fed to the direction determination unit 14 for this purpose. As a result of the direction determination the compressor 12 is then set. The behavior of the compressor 12 is defined by a compression scheme K, which is then changed depending on the relevant direction R in order to obtain an emphasis of a relevant sound source in said direction.

Figure 4:
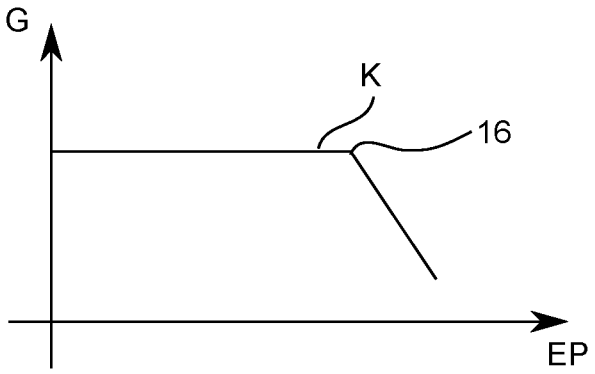
FIG. 4 is a graph showing a compression scheme.

An example compression scheme K is shown in FIG. 4, here in a representation as a gain G as a function of an input level EP, i.e. of a level of the input signal E. The compression scheme K shown has a knee point 16, which defines two level ranges with different compression ratios. At a lower level range a constant gain is implemented, while at an upper level range the gain is reduced with increasing input level. The compression scheme is then changed as a function of the relevant direction R, for example, by the knee point 16 being shifted to bring about a change in behavior of the compressor 12.

Figure 5:
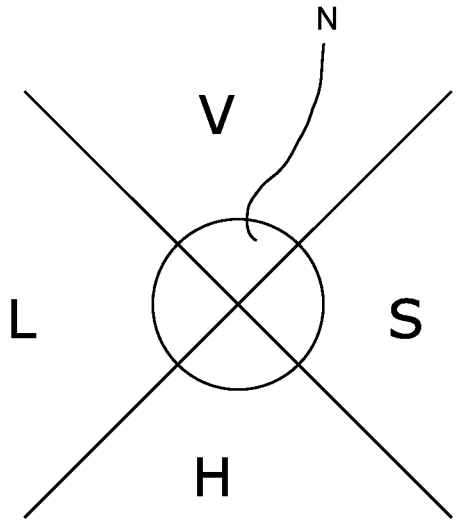
FIG. 5 is an illustration of a subdivision of an environment into a plurality of directions.

The environment of the user N is divided into a plurality of directions, for example, as shown in FIG. 5, into four directions "front" V, "rear" H, "left" L and "right" S. From these directions, the direction determination unit 14 selects one as the relevant direction R and this is the direction which will then be emphasized over the other directions. For this purpose, the input signal E is modified in a direction-dependent way by the compressor 12 being operated with a compression scheme K, which is dependent on the relevant direction R. Thus, the information as to the direction in which a relevant sound source is located is used to modify the input signal E selectively and to reproduce this sound source more clearly for the user N.

The relevant direction R is selected according to its relevance to the user N. In particular, a direction is relevant if a sound source of a particular type is present there, for example, a person speaking, or if the sound source has a higher volume than other sound sources in the same direction, i.e. a higher sound level, for example a person speaking in a crowd. To determine the relevant direction R the input signal E is analyzed by the direction determination unit 14 and this analysis is used as a basis for determining the direction in which a sound source is located which is relevant to the user N, so that this direction R is then selected as the relevant direction. For example, for this purpose the hearing aid 2 has a classifier, not shown, to assign sound sources in the environment to a specific type, so that the direction selected as the relevant direction R is that in which a sound source of a particular type is located.

In FIG. 2 an input signal E is now generated by a single microphone 7 and fed to the compressor 12 and to the direction determination unit 14. The direction determination unit 14 determines, on the basis of the input signal E, a relevant direction R and thereby controls the compressor 12, by changing the compression scheme K depending on the relevant direction R. A modified input signal Emod is thus generated dependent on direction, which is then output via the speaker 6 as an output signal A.

In FIG. 3 the direction determination unit 14 has a beam former 30, which from an input signal E from a plurality of multiple microphones 7 generates a plurality of directed input signals Eger, i.e., the input signal E is decomposed into a plurality of directed input signals Eger. Each of the directed input signals Eger is assigned to one of the directions and is thus generated only or at least predominantly from acoustic signals from this one direction. The directed input signals are then fed to the compressor 12 where they are modified separately, so that a plurality of modified input signals Emod is generated, which are then combined to form the output signal A.

Figure 6:
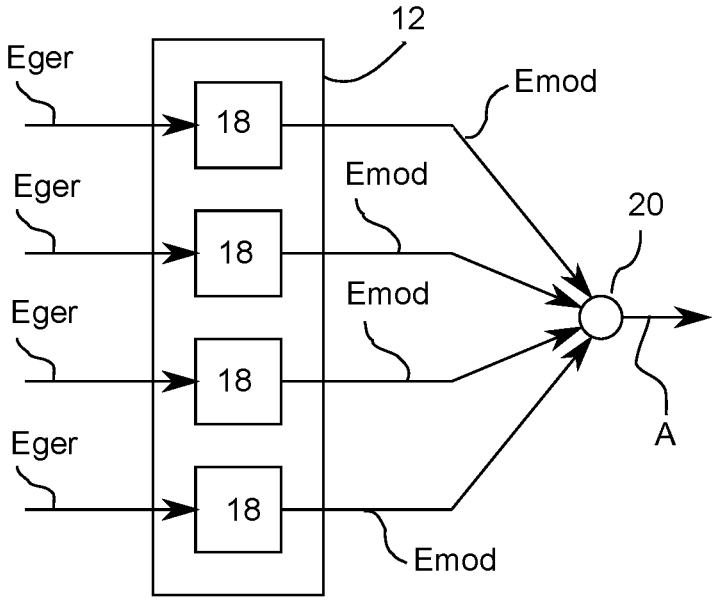
FIG. 6 is a block diagram of a compressor with a plurality of instances.

A possible design of the suitable compressor 12 is shown in FIG. 6. The compressor 12 shown there has a plurality of instances 18, to each of which one of the directed input signals Eger is fed. These instances 18 are therefore also referred to as direction instances. In addition, each instance 18 is operated with a separate instance scheme, which is set depending on the relevant direction R. Each directed input signal Eger is thus modified separately and therefore a separate compression scheme, namely the respective instance scheme, is used for each direction, which means that the acoustic signals from each individual direction are optimally compressed independently of the acoustic signals of the other directions. The modified input signals Emod are then mixed together in a mixer 20. In particular, a relative proportion of the modified input signals Emod is adjusted at the output signal A in such a way that an optimal compression scheme K is obtained overall.

Figure 7:
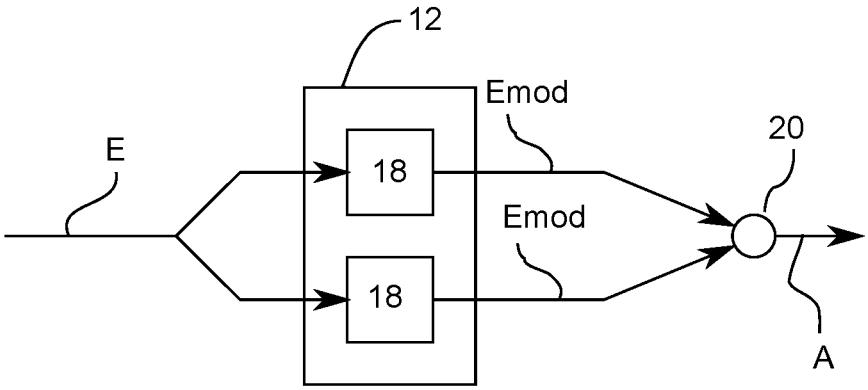
FIG. 7 is a block diagram of a compressor which has a plurality of instances to which the complete input signal is fed.

FIG. 7 shows the compressor 12, which has a plurality of instances 18, to which the complete input signal E is fed. In contrast to FIG. 6, where a different signal, namely one directed input signal Eger each, is fed to each instance 18, in FIG. 7 the same signal is fed to each of the instances 18, in this case the input signal E. The individual instances 18 are operated with different instance schemes, so that the input signal E is modified in a different way in every instance 18 and different modified input signals Emod are obtained, which are then combined in a mixer 20 to form the output signal. The individual instances 18 in this case are also referred to as compression instances. In contrast, a plurality or all of the instances 18 in FIG. 6 are also operated with the same instance scheme as required. The different instance schemes in FIG. 7 in the present case are designed for different sound sources and, in general, different situations, thus one of the instance schemes is a speech scheme for emphasizing speech, and the other instance scheme is a sound scheme which implements the optimally realistic reproduction of acoustic signals of the environment, and matched to the hearing loss of the user N.

In an alternative design, not shown, the embodiments of FIGS. 6 and 7 are combined in such a way that instead of being fed to each of the individual instances 18 in FIG. 6, a respective directed input signal Eger is fed to a plurality of instances 18 as in FIG. 7, in order, for example, to implement a mixture of different instance schemes for a single direction. For the specific case of FIG. 6 and 7, the compressor 12 would then have eight instances, namely one instance with a speech scheme and one with a sound scheme for each direction.

The following is a summary list of reference numerals and the corresponding structure used in the above description of the invention:

2 hearing device
4 signal processor
6 loudspeaker/receiver
7 microphone
8 housing
10 Automatic Gain control AGC
12 compressor
14 direction determination unit
16 knee point
18 instance
20 mixer
A output signal
E input signal
Eger directed input signal
Emod modified input signal
EP input level
G gain
H rear
K compression scheme L left
N user
R relevant direction
S right
V front

The invention claimed is:

1. A method for operating a hearing aid, which comprises the steps of:

generating, via the hearing aid, an input signal from acoustic signals from an environment, the hearing aid having a signal processor configured to modify the input signal and thereby generate an output signal, wherein in order to modify the input signal the signal processor having an automatic gain controller with a compressor, which can be operated with a compression scheme;

subdividing the environment into a plurality of directions, one of the directions is selected by means of a direction determination unit as a relevant direction; and modifying the input signal in a direction-dependent manner by the compressor being operated with the compression scheme which is set depending on the relevant direction, so that acoustic signals from the relevant direction are emphasized compared to acoustic signals from other directions, wherein the compression scheme is selected from a set of compression schemes containing: a speech scheme for emphasizing speech components, and a sound scheme for adapting only to a hearing profile of a user of the hearing aid.

2. The method according to claim 1, wherein the direction determination unit has a beam former, by means of the beam former the environment is subdivided into the plurality of directions, which is used to determine the relevant direction.

3. The method according to claim 1, wherein the compression scheme is defined by at least one compression parameter, and the compression scheme is set depending on the relevant direction by the compression parameter being modified depending on the relevant direction.

4. The method according to claim 1, which further comprises modifying the input signal direction-dependently only if a directed acoustic signal is detected in the environment, and wherein otherwise the input signal is modified independently of a direction.

5. The method according to claim 1, wherein several of the plurality of directions are selected as the relevant direction.

6. The method according to claim 1, which further comprises subdividing the environment into exactly four directions, namely front, rear, left and right.

7. A method for operating a hearing aid, which comprises the steps of:

generating, via the hearing aid, an input signal from acoustic signals from an environment, the hearing aid having a signal processor configured to modify the input signal and thereby generate an output signal, wherein in order to modify the input signal the signal processor having an automatic gain controller with a compressor, which can be operated with a compression scheme;

subdividing the environment into a plurality of directions, one of the directions is selected by means of a direction determination unit as a relevant direction;

modifying the input signal in a direction-dependent manner by the compressor being operated with the compression scheme which is set depending on the relevant direction, so that acoustic signals from the relevant direction are emphasized compared to acoustic signals from other directions, wherein the compressor having a plurality of instances which can be operated with different instance schemes, wherein a particular instance scheme is configured to emphasize a particular type of acoustic signal, the method which further comprises the substeps of:

feeding the input signal to the plurality of instances, which then generate a corresponding number of modified input signals, which are then combined together to form the output signal; and adjusting a relative proportion of the modified input signals to one another in the output signal depending on the relevant direction, so that the compression scheme is set as a mixture of the instance schemes.

8. The method according to claim 7, wherein:

the input signal has a plurality of directed input signals, each of which is assigned to one of the plurality of directions;

for each of the directed input signals, the compressor has one instance which is operated with a respective instance scheme; and one of the directed input signals is fed to a respective instance so that the compression scheme is set as the mixture of the instance schemes.

9. The method according to claim 7, wherein for each of the directions a respective instance scheme for a respective directed input signal is set depending on a type of acoustic signal in an assigned direction.

10. The method according to claim 9, wherein the compression scheme, namely the respective instance scheme which is set, is selected from a set of compression schemes containing: a speech scheme for emphasizing speech components, and a sound scheme for adapting only to a hearing profile of a user of the hearing aid.

11. A hearing aid, comprising:

a signal processor having an automatic gain controller with a compressor being operated with a compression scheme and a direction determination unit; and the hearing aid being programmed to:

generate an input signal from acoustic signals from an environment;

subdivide the environment into a plurality of directions, one of the directions is selected by means of said direction determination unit as a relevant direction;

modify the input signal in a direction-dependent manner by the compressor being operated with the compression scheme which is set depending on the relevant direction, so that acoustic signals from the relevant direction are emphasized compared to acoustic signals from other directions resulting in a modified input signal;

perform one of:

a) select the compression scheme from a set of compression schemes containing: a speech scheme for emphasizing speech components, and a sound scheme for adapting only to a hearing profile of a user of the hearing aid; or b) form the compressor to have a plurality of instances which can be operated with different instance schemes, wherein a particular instance scheme is configured to emphasize a particular type of acoustic signal:

b1) feed the input signal to the plurality of instances, which then generate a corresponding number of modified input signals, which are then combined together to form the output signal; and b2) adjust a relative proportion of the modified input signals to one another in the output signal depending on the relevant direction, so that the compression scheme is set as a mixture of the instance schemes; or c) provide the input signal with a plurality of directed input signals, each of the directed input signals being assigned to one of the plurality of directions, for each of the directed input signals, the compressor has one instance which is operated with a respective instance scheme, and one of the directed input signals is fed to a respective instance so that the compression scheme is set as the mixture of the instance schemes; and generate an output signal from the modified input signal.

12. A method for operating a hearing aid, which comprises the steps of:

generating, via the hearing aid, an input signal from acoustic signals from an environment, the hearing aid having a signal processor configured to modify the input signal and thereby generate an output signal, wherein in order to modify the input signal the signal processor having an automatic gain controller with a compressor, which can be operated with a compression scheme;

subdividing the environment into a plurality of directions, one of the directions is selected by means of a direction determination unit as a relevant direction;

modifying the input signal in a direction-dependent manner by the compressor being operated with the compression scheme which is set depending on the relevant direction, so that acoustic signals from the relevant direction are emphasized compared to acoustic signals from other directions, wherein:

the input signal has a plurality of directed input signals, each of which is assigned to one of the plurality of directions;

for each of the directed input signals, the compressor has one instance which is operated with a respective instance scheme; and one of the directed input signals is fed to a respective instance so that the compression scheme is set as the mixture of the instance schemes.

* * * * *